US007988566B2

(12) United States Patent
Kim et al.

(10) Patent No.: US 7,988,566 B2
(45) Date of Patent: Aug. 2, 2011

(54) SOFT GOLF CLUB HEAD

(75) Inventors: Nam-Gyun Kim, Jeollabuk-do (KR); Dong-Wook Kim, Jeollabuk-do (KR)

(73) Assignee: Industrial Cooperation Foundation Chonbuk National University, Jeollabuk-Do (KR)

( * ) Notice: Subject to any disclaimer, the term of this patent is extended or adjusted under 35 U.S.C. 154(b) by 93 days.

(21) Appl. No.: 12/377,554

(22) PCT Filed: Jul. 12, 2007

(86) PCT No.: PCT/KR2007/003374

§ 371 (c)(1),
(2), (4) Date: Feb. 13, 2009

(87) PCT Pub. No.: WO2009/008563

PCT Pub. Date: Jan. 15, 2009

(65) Prior Publication Data

US 2010/0248859 A1 Sep. 30, 2010

(51) Int. Cl.
*A63B 53/06* (2006.01)

(52) U.S. Cl. ..... 473/329

(58) Field of Classification Search ..... 473/324, 473/329, 524, 539, 548, 534, 238, 242
See application file for complete search history.

(56) References Cited

U.S. PATENT DOCUMENTS

| | | | | | |
|---|---|---|---|---|---|
| D222,753 | S | * | 12/1971 | Cook | D21/744 |
| 3,884,468 | A | * | 5/1975 | Cook | 473/340 |
| 4,340,224 | A | * | 7/1982 | Staats | 473/563 |
| 4,340,225 | A | * | 7/1982 | Wilson | 473/534 |
| 4,593,905 | A | * | 6/1986 | Abel | 473/534 |
| 5,364,103 | A | | 11/1994 | Chen et al. | |
| 5,505,453 | A | * | 4/1996 | Mack | 473/329 |
| 5,605,510 | A | * | 2/1997 | Schmidt et al. | 473/251 |
| 6,257,999 | B1 | * | 7/2001 | Dahm | 473/563 |
| 6,682,439 | B2 | | 1/2004 | Brown | |

FOREIGN PATENT DOCUMENTS

| | | | | |
|---|---|---|---|---|
| JP | 3093707 | U | | 2/2003 |
| JP | 2005110852 | A | * | 4/2005 |
| JP | 2007117474 | A | * | 5/2007 |
| KR | 2003-0090028 | A | | 11/2003 |
| KR | 1020050037422 | | * | 11/2006 |
| KR | 1020060115096 | | | 11/2006 |
| KR | 10-0664354 | A | | 12/2006 |
| WO | WO 8001757 | A1 | * | 9/1980 |

* cited by examiner

*Primary Examiner* — Stephen L. Blau
(74) *Attorney, Agent, or Firm* — Rabin & Berdo, P.C.

(57) ABSTRACT

Provided is a soft golf club head that forms a striking surface with a plurality of strings fixed to a body of the head and a tension adjusting screw to enable adjusting of string tension, so that shock transferred to a golfer is reduced, flight distance of the golf ball can be adjusted, and a broader demography can enjoy golfing with less restrictions.

3 Claims, 8 Drawing Sheets

SOFT GOLF CLUB HEAD

BACKGROUND OF THE INVENTION

1. Field of the Invention

The present invention relates to a soft golf club head, and more particularly, to a soft golf club head that forms a striking surface with a plurality of strings fixed to a body of the head and a tension adjusting screw provided at one end of the strings to enable adjusting of string tension, so that shock transferred to a golfer is reduced, flight distance of the golf ball can be adjusted, and a broader demography can enjoy golfing with less restrictions.

2. Description of the Related Art

Golf is a sport in which a stationary ball is struck with a club to direct it toward a predetermined hole on the golf course. The number of strokes required to sink the ball determines the ranking of players. An official golf course covers a wide area of 660,000-1,000,000 $m^2$, including fields, hills, and woodland. There are both seaside and inland golf courses.

Golf is played with a golf club and a golf ball. The golf club includes a head with a surface for striking the golf ball, and a shaft with a grip provided at the upper portion for grasping the golf club. Golf clubs can be divided into three categories—woods, irons, and putters—depending on the shape of the head and its material. The type of head determines the application of each club.

A wood provides the longest flight distance of the golf clubs, and is suitable for use in cases were other clubs cannot reach a long-distance hole. An iron is used when the hole is a moderate distance away, and the use of a putter is suitable when the hole is a short distance away.

Also, a wedge (which is a type of iron) is a golf club used in situations requiring high loft of the golf ball.

However, the above-described golf clubs are designed to be used primarily by adults, and can be difficult for elderly golfers, physically disabled golfers, and those with other special needs.

That is, in the case of elderly golfers, because vibration from when the golf ball is struck is transmitted to the grasping hands through the handle, wrist discomfort is likely to ensue.

Also, due to the expansive size of a golf course, it may be difficult for elderly or physically disabled golfers to traverse the entire course for a full round of golf.

To overcome these obstacles, Korean Patent Publication No. 2003-90028 entitled "Soft Golf Course and Tools", which is hereby incorporated by reference, discloses a golf course with the same overall size as a standard course, but which divides the overall size into smaller courses that are playable by elderly or physically disabled golfers. Furthermore, in order to reduce the flight distance of golf balls, in Korean Patent Publication No. 664354 entitled "Soft Golf Club", which is hereby incorporated by reference, a soft golf club is used to allow elderly or physically disabled golfers to enjoy the sport.

However, because the soft golf clubs proposed in the related art fail to take loft and lie angles into account (as shown in the diagrams), they can only offer golfers the satisfaction of simply hitting a ball, and do not allow golfers the ability to experience the finer points of the stroke during a game.

Therefore, when the above-described golf clubs are used in a game, they can only provide a limited feeling of playing golf in being able to select a suitable club according to its flight distance and reducing one's number of strokes. Therefore, the game of golf can become boring and uninvolved, which can lead to a reduction in the exercising benefits that accompany playing golf.

SUMMARY OF THE INVENTION

Accordingly, the present invention is directed to a soft golf club head that substantially obviates one or more problems due to limitations and disadvantages of the related art.

An object of the present invention is to provide a soft golf club head that forms a loft angle and a lie angle used by the head, and a striking surface with an adjustable tension level that can be customized to fit an individual golfer's physical characteristics, thereby enabling elderly or physically disabled golfers to enjoy golf and increase the demography of players.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, there is provided a golf head for a soft golf club having a shaft forming a gripping portion at a top thereof, and a head coupled at a lower end of the shaft and forming a striking surface for striking a golf ball, the golf head including: a body with an outer circumference of a predetermined thickness forming a striking space in a center thereof, and a plurality of insert holes formed in the outer circumference; a shaft housing formed on a side of the body, and including a receiving hole in which a lower end of the shaft is inserted and fixed; at least one or more of a string for forming the striking surface over the striking space on the body, wherein one end of the one or more of the string is fixed to one of the insert holes, and the other end is fixed to another of the insert holes correspond to the one insert hole; and a tension adjusting screw provided on one side of the body, for tightening or loosening the one end of the one or more of the string and controlling the tension of the striking surface.

The golf head may further include a bumper formed respectively on each of the insert holes formed in the outer circumference, for minimizing a transferal of striking shock from the striking surface formed by the string to edges of the insert holes contacting the string. The outer circumference of the body may include a recessed region recessed a predetermined depth inward from an outer surface thereof, and the insert holes may be formed in the recessed region. The golf head may have a loft angle of $1_1$ and a lie angle of $1_2$, for retaining a shape of a conventional golf club.

According to another aspect of the present invention, there is provided a golf head for a soft golf club having a shaft forming a gripping portion at a top thereof, and a head coupled at a lower end of the shaft and forming a striking surface for striking a golf ball, the golf head including: a body with an outer circumference of a predetermined thickness forming a striking space in a center thereof, and a plurality of insert holes formed in the outer circumference; a shaft housing formed on a side of the body, and including a receiving hole in which a lower end of the shaft is inserted and fixed; and a striking membrane forming a striking surface at a front of the body, wherein ends of the striking membrane are fixed to the body using fixing members.

The body may have a coating layer formed on an outer surface thereof for minimizing shearing stress generated between the outer surface of the body and the striking membrane when a golf ball is struck with the striking membrane.

The golf head may further include a weight-balancing portion formed on a side of the body, for facilitating a swing of a golfer. The body and the shaft housing of the golf head may be formed of a compound resin that is easily formed and has a high degree of strength, and the golf head may have a balancing weight insert injection molded in a rear, lower portion thereof, for facilitating a swing of a golfer.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of a soft golf club head according to the present invention, examples of which are illustrated in the accompanying drawings. Wherever possible, the same reference numbers will be used throughout the drawings to refer to the same or like parts.

Figure 1:
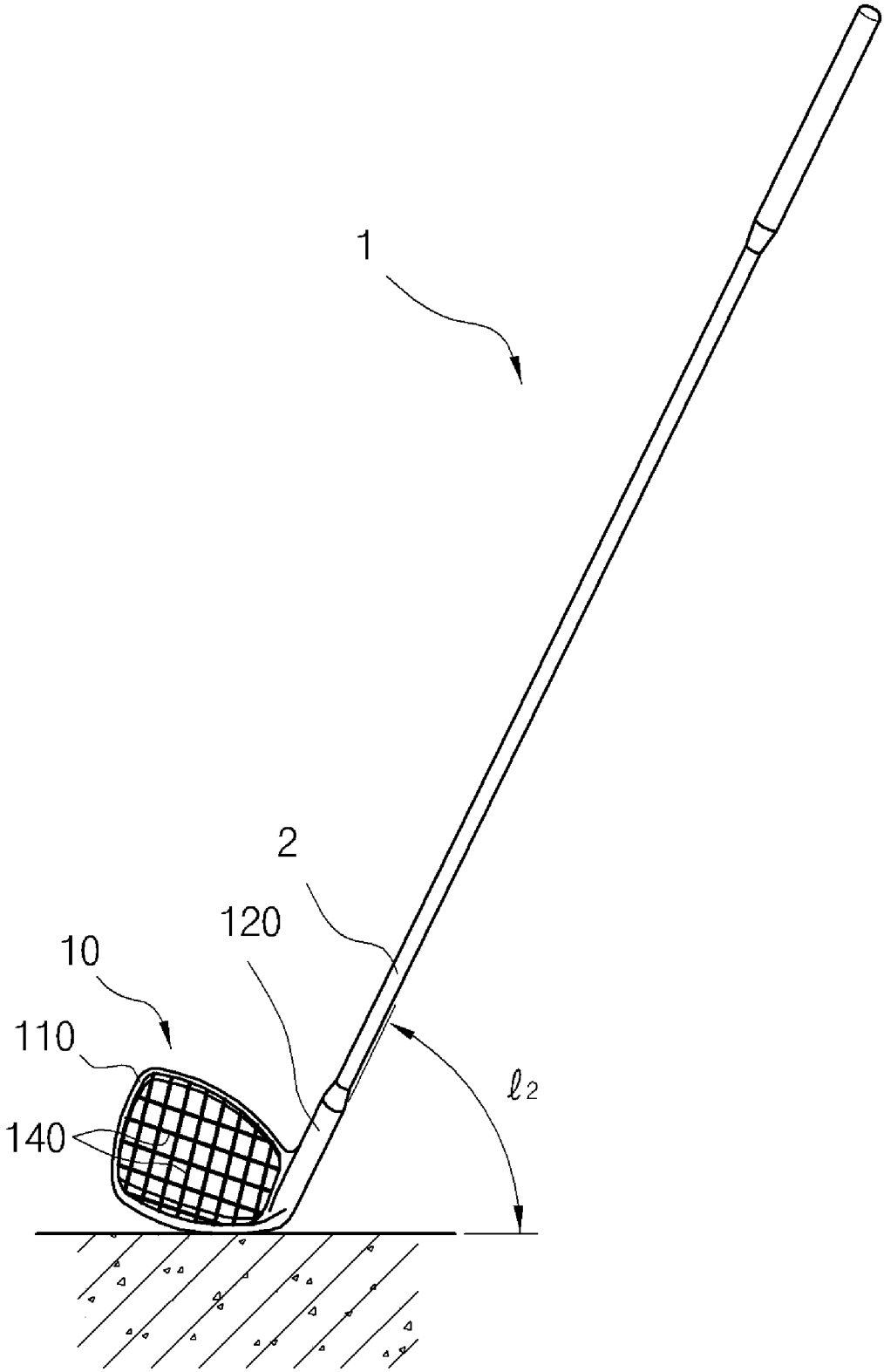
FIG. 1 is a perspective view of a soft golf club according to the present invention.
Figure 2:
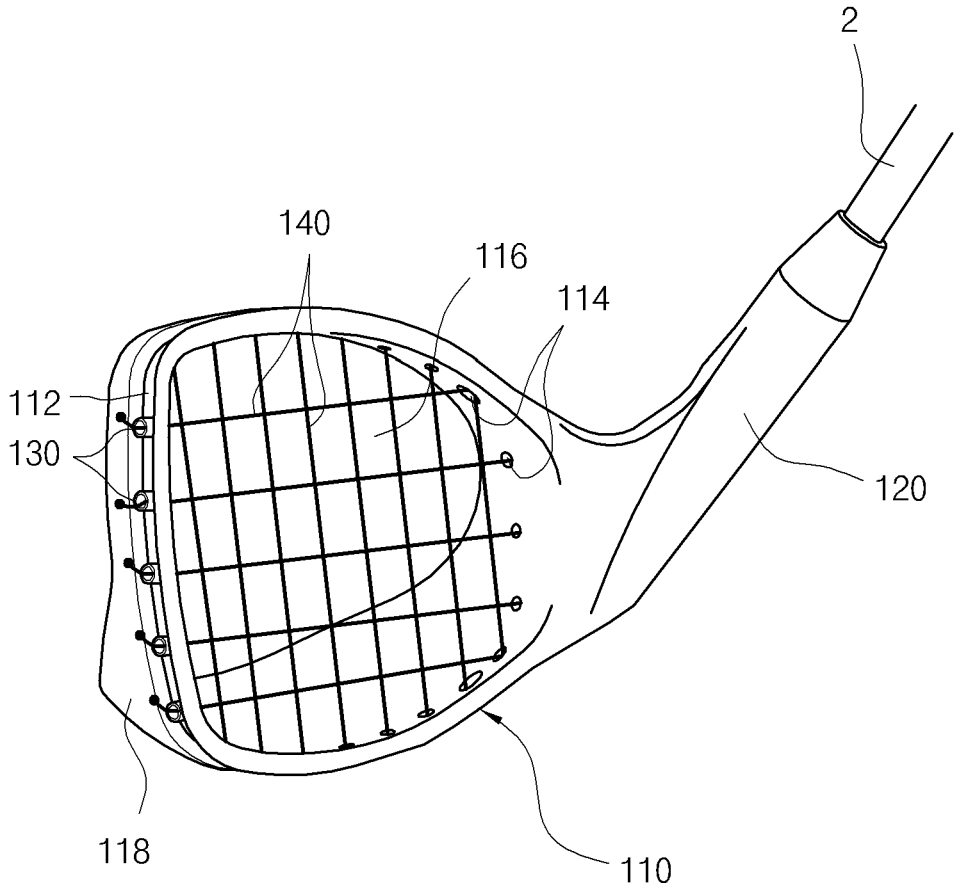
FIG. 2 is a perspective view of a soft golf club head according to the first embodiment of the present invention.
Figure 3:
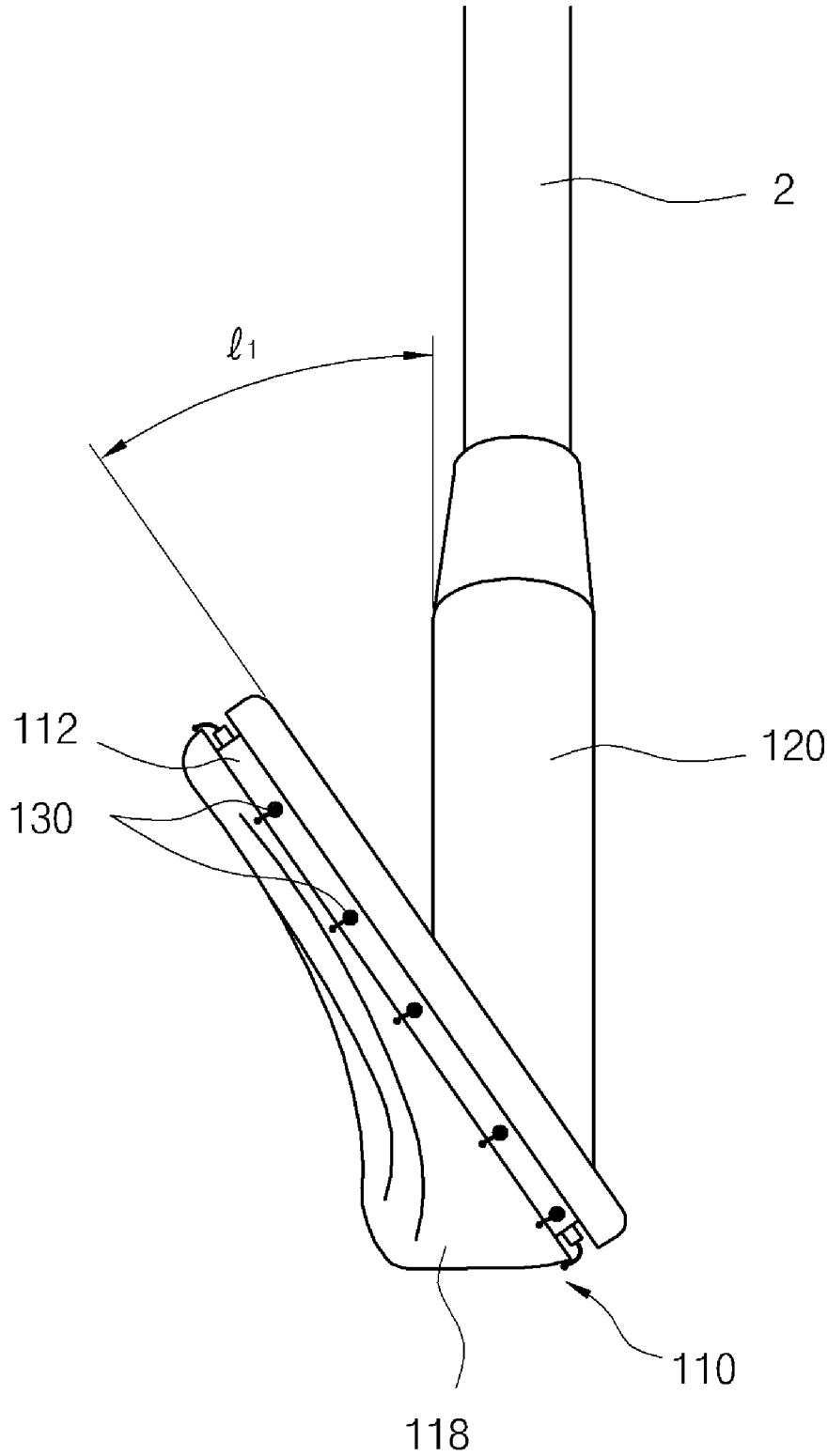
FIG. 3 is a side view of a golf club head according to the first embodiment of the present invention.
Figure 4:
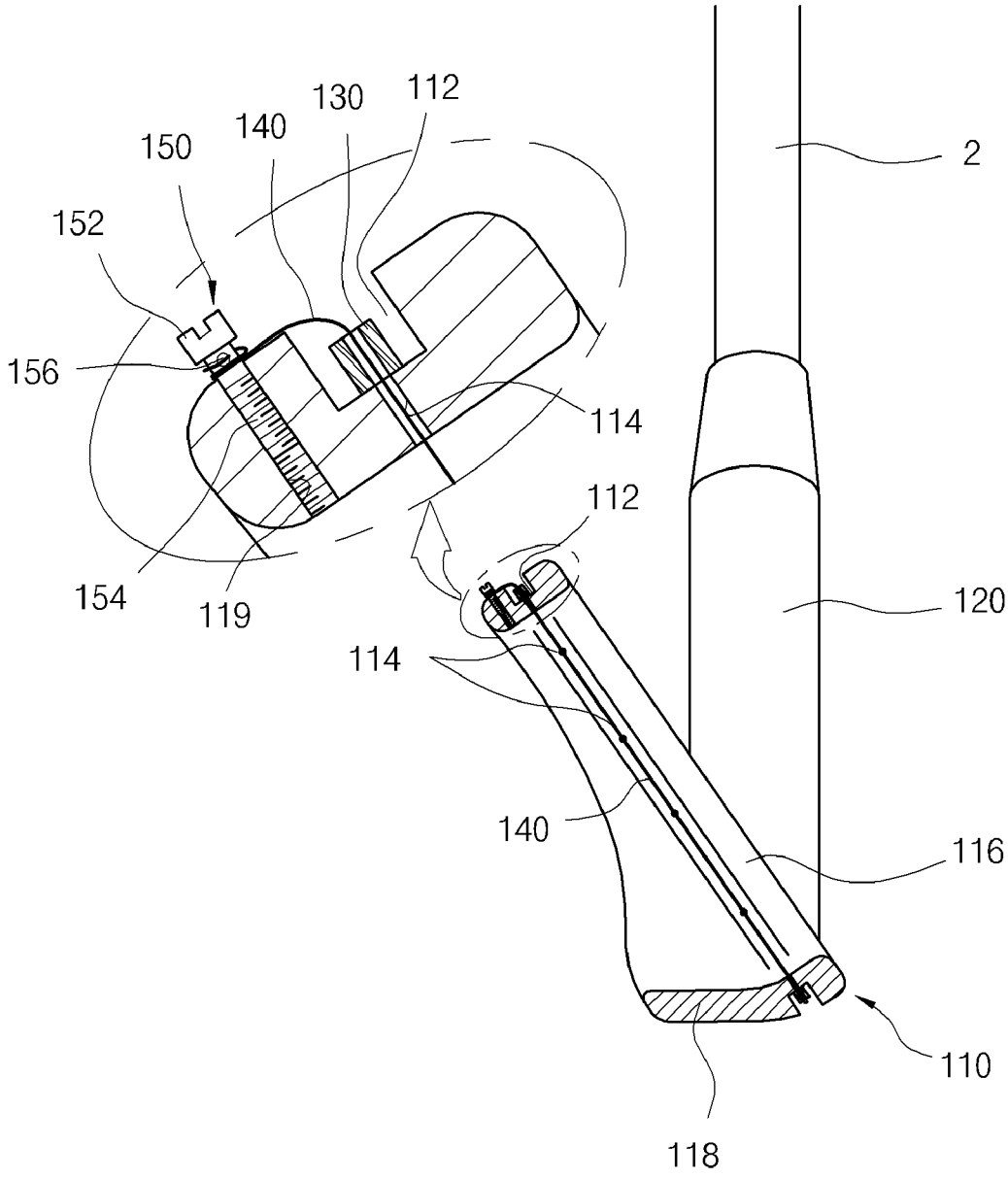
FIG. 4 is a sectional view of the golf club head in FIG. 3.

FIG. 1 is a perspective view of a soft golf club according to the present invention, FIG. 2 is a perspective view of a soft golf club head according to the first embodiment of the present invention, FIG. 3 is a side view of a golf club head according to the first embodiment of the present invention, and FIG. 4 is a sectional view of the golf club head in FIG. 3. Referring to FIGS. 1 through 4, a soft golf club 1 includes a shaft 2 forming a gripping portion at the upper end thereof, and a head 10 inserted over and fixed to the lower end of the shaft 2.

The head 10 has a shape similar to a conventional golf club with a loft angle of $1_1$ and a lie angle of $1_2$.

Of course, the loft angle $1_1$ and the lie angle of $1_2$ may be formed the same as the loft angle $1_1$ and the lie angle of $1_2$ of a conventional golf club. Also, the loft angle $1_1$ and the lie angle of $1_2$, like those of conventional golf club heads 10, may vary depending on the head type. Furthermore, the shape of the head 10 may have a similar shape to that of a conventional golf club head.

The loft angle $1_1$ and the lie angle of $1_2$ of the head are the same in the second and third embodiments of the present invention.

The head 10 according to the first embodiment of the present invention includes a body 110 forming a striking surface, and a shaft housing 120 formed at a side of the body 110, with a center through which the lower end of the shaft 2 passes and is fixed.

In order to form a striking space 116, the body 110 forms an outer perimeter of a predetermined thickness, around an outer surface of which a recessed region 112 is formed recessed therein, and a plurality of insert holes 114 are formed in the recessed region 112.

Furthermore, a weight-balancing portion 118 is formed at one side of the body 110 in order for the golfer to easily execute a centrifugal swing using the weight thereof. The weight-balancing portion 118 may be formed to protrude a predetermined distance at the rear, lower end of the body 110.

The insert holes 114 are formed in plurality corresponding to the shape of the body 110.

Also, a bumper 130 is formed on the plurality of insert holes 114 to absorb the shock generated from striking a golf ball. The bumper 130 may be formed of a soft elastic material such as rubber or silicon that can readily absorb shock.

At least one or more strings 140 forms a striking surface of the body 10.

The strings 140 may be formed of a highly resilient compound resin, a metal material, or a variety of other materials.

The strings 140 are inserted through the plurality of insert holes 114 formed in the body 110 to form the striking surface of the body 110. As shown in the diagrams, the strings 140 may be formed in a criss-crossing, parallel, or oblique arrangement.

Furthermore, the strings 140 may be formed either as a single string forming a striking surface, or as multiple strings that are inserted and fixed through corresponding insert holes 114 formed in the body 110. Here, the latter method may be used.

Specifically, one end of the string 140 is inserted and fixed in one of two opposing insert holes 114, and the other end of the string 140 is inserted and fixed in the other insert hole 114. In this way, a plurality of strings 140 is fixed to form a striking surface on the body 110.

Also, the strings 140 fixed in the insert holes 114 are prevented from directly contacting the surface of the body 110 by means of a bumper 130 formed on each of the insert holes 114. When a golf ball is struck with the striking surface formed by the strings 140, the resulting shock that is generated is absorbed by the bumper 130, preventing damage to the strings 140.

A tension adjusting screw 150 is formed on a side of the body 110, and includes a head portion 152 and a screw portion beneath the head portion 152. An inserting recess for inserting a screwdriver, wrench, or other tool is formed in the head portion 152.

A through-hole 156 is formed through the screw portion 154 of the tension adjusting screw 150, for inserting and fixing one end of the string 140 through.

Of course, a fastening hole 119 is formed in the body 110 to accommodate the tension adjusting screw 150, for fixing the screw portion 154 of the tension adjusting screw 150 therein.

Accordingly, the screw portion 154 of the tension adjusting screw 150 is fastened in the fastening hole 119 of the body 110, and one end of the string 140 formed on the body 110 is inserted and fixed in the through-hole 156 of the screw portion 154. Thus, with one end of the string 140 inserted and fixed through one end of the insert holes 114, the tension of the string 140 can be adjusted by tightening or loosening the tension adjusting screw 150.

Figure 5:
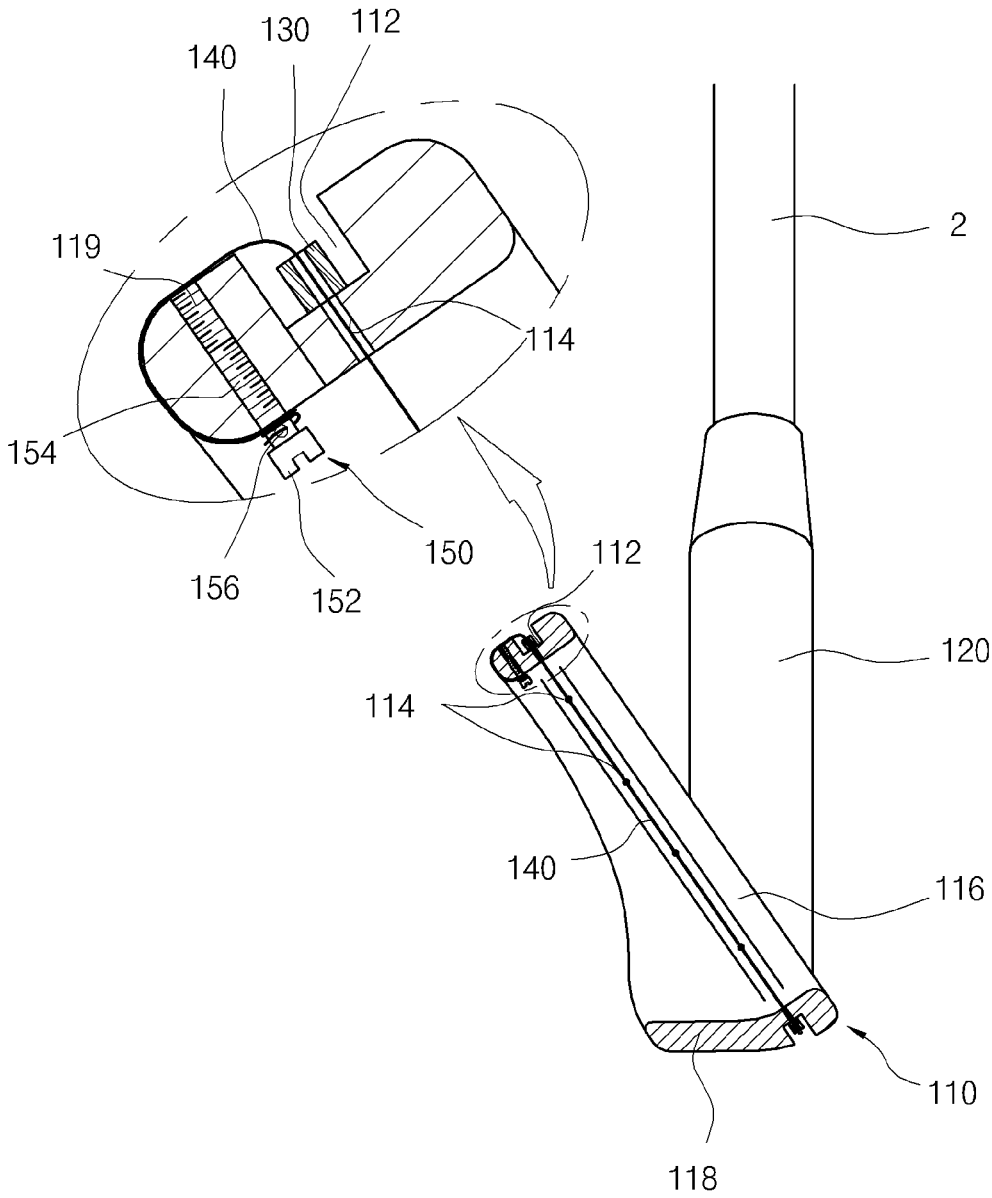
FIG. 5 is a sectional view showing another embodiment of a tension adjusting screw of a golf club head according to the present invention.
Figure 6:
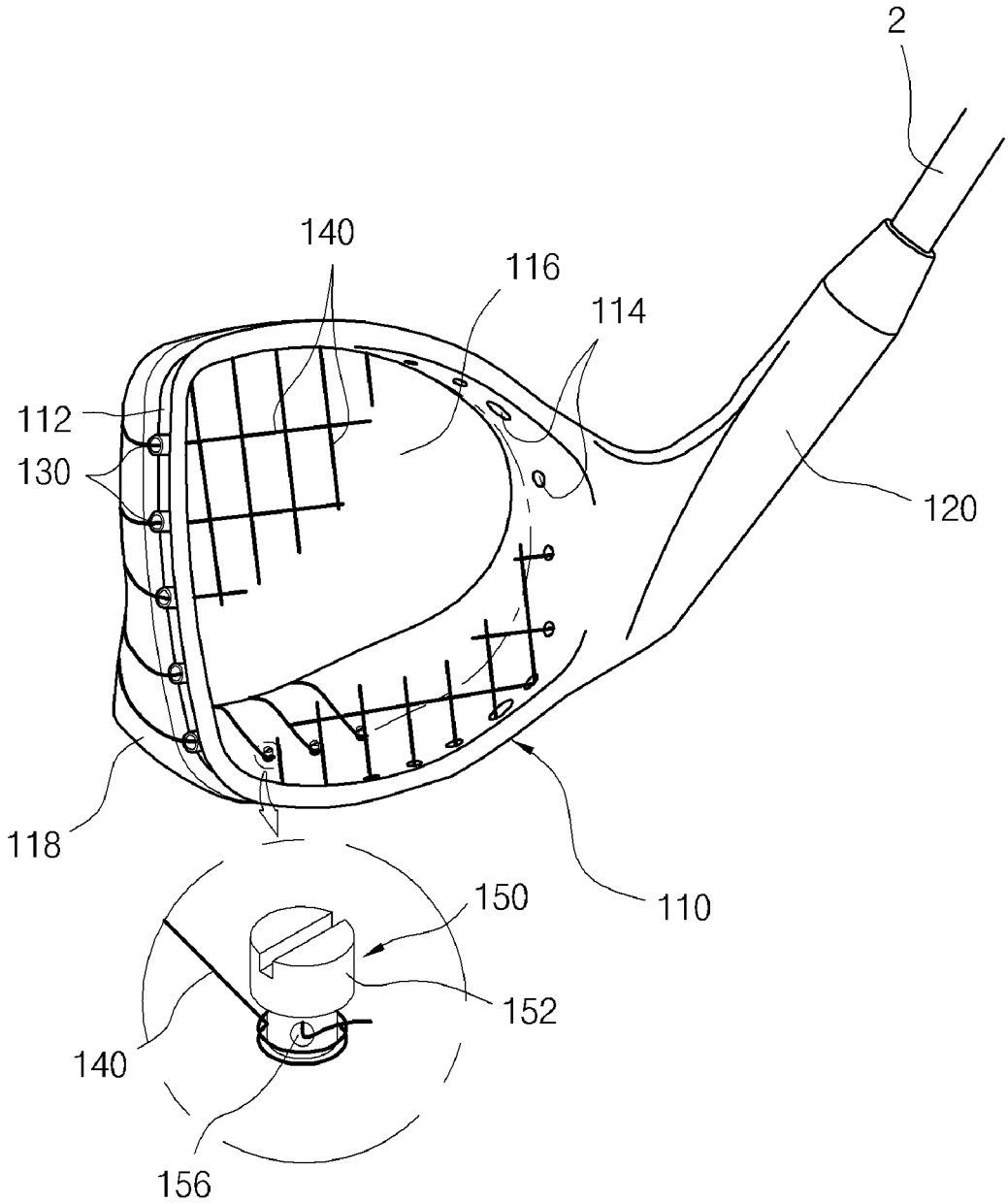
FIG. 6 is a perspective view of the head in FIG. 5.

FIG. 5 is a sectional view showing another embodiment of a tension adjusting screw of a golf club head according to the present invention, and FIG. 6 is a perspective view of the head in FIG. 5. Referring to FIGS. 5 and 6, the tension adjusting screw 150 may be disposed within the inner region of the striking space 116 at the center of the body 110.

While the striking space for striking a golf ball is formed using a plurality of strings 140 formed on the body 110 of the golf club head 10 in the sport golf club, as described above, the flight distance of a struck golf ball is approximately ⅓ that of a conventional golf club, so that the club of the present invention may be used on a soft golf course or in an indoor golf course.

Also, when a golf ball is struck, the ensuing shock is absorbed to a certain degree by the bumper 130 formed on the insert holes 114 in which the strings 140 forming the striking surface are inserted and fixed. Thus, the shock transmitted to the golfer is minimized, and damage to the golfer's wrists can be prevented.

The bumper 130 also prevents direct contact between the surface of the body 110 and the string 140, so that the shearing stress occurring between the body 110 and a side of the string 140 from the shock of hitting a golf ball can be reduced to prevent severing of the string 140 and extend the life thereof.

In order to prevent damage to wrists of elderly or physically disabled golfers, for example, the tension adjusting screw 150 may be loosened in accordance with the golfer's physical characteristics, to lessen the tension of the string 140 formed on the body 110 and reduce the shock from hitting a golf ball.

When the tension adjusting screw 150 is tightened, the tension of the string 140 is increased, thereby increasing the sensation of hitting the ball to a level comparable to a conventional golf club. Thus, physically fit golfers can use the golf club in indoor golf courses or soft golf courses for practicing stance, swings, etc.

Therefore, the above-structured head is not limited to use by one type of golfer, but can be used both by elderly and physically disabled golfers as well as physically fit golfers in indoor or soft golf courses.

Figure 7:
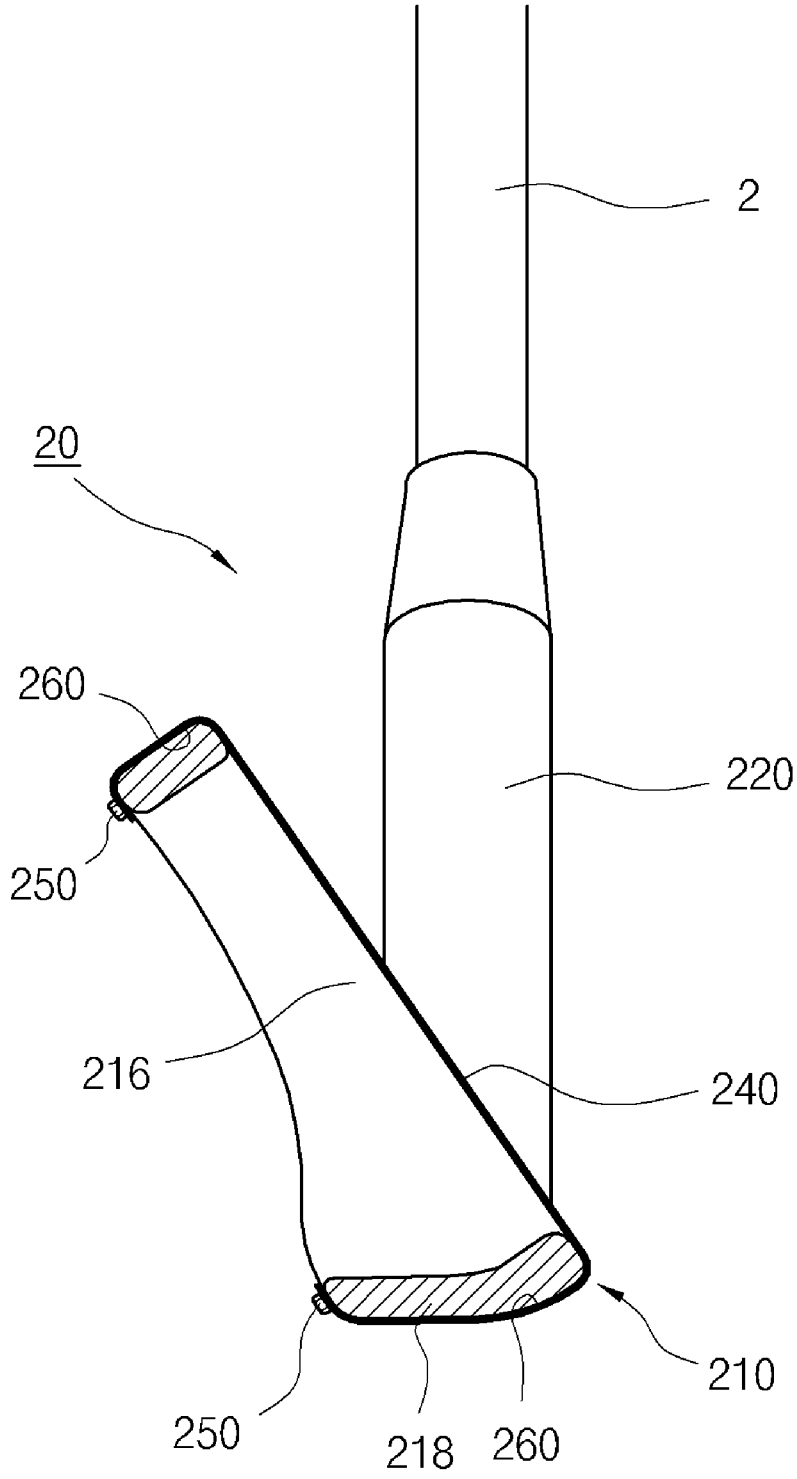
FIG. 7 is a sectional view of a golf club head according to the second embodiment of the present invention.

FIG. 7 is a sectional view of a golf club head according to the second embodiment of the present invention. Referring to FIG. 7, a head 20 according to the second embodiment includes a body 210 with an outer perimeter formed of a predetermined thickness forming a striking space 116 within and having a weight balancing portion 218 at the rear, lower end thereof for providing a weighted feel; a shaft housing 220 formed on a side of the body 210 and into which the lower end of the shaft 2 is inserted and fixed; and a striking membrane 240 covering the front surface of the body 210 and having one end fixed by a fixing member 250.

The striking membrane 240 may be formed of a highly elastic compound resin such as rubber or silicon or a textile material.

The fixing member 250 is a means for securely fixing the striking membrane 240 to the body 210, and may be embodied in various forms, such as a fastening screw, a fixing rivet, etc.

The striking membrane 240 encloses the front surface of the body 210, and its end portions are disposed at the rear surface of the body 210. The portion of the striking membrane 240 disposed at the rear surface of the body may be fixed thereto using the fixing member 250.

The above-structured head 20 according to the second embodiment forms a striking surface for striking a golf ball with the striking membrane 240 covering the body 210. The shock from when a golf ball is struck is absorbed by the entirety of the striking membrane 240, so that the flight distance is shortened and the shock transferred to the golfer is lessened, thereby protecting wrists from damage.

Figure 8:
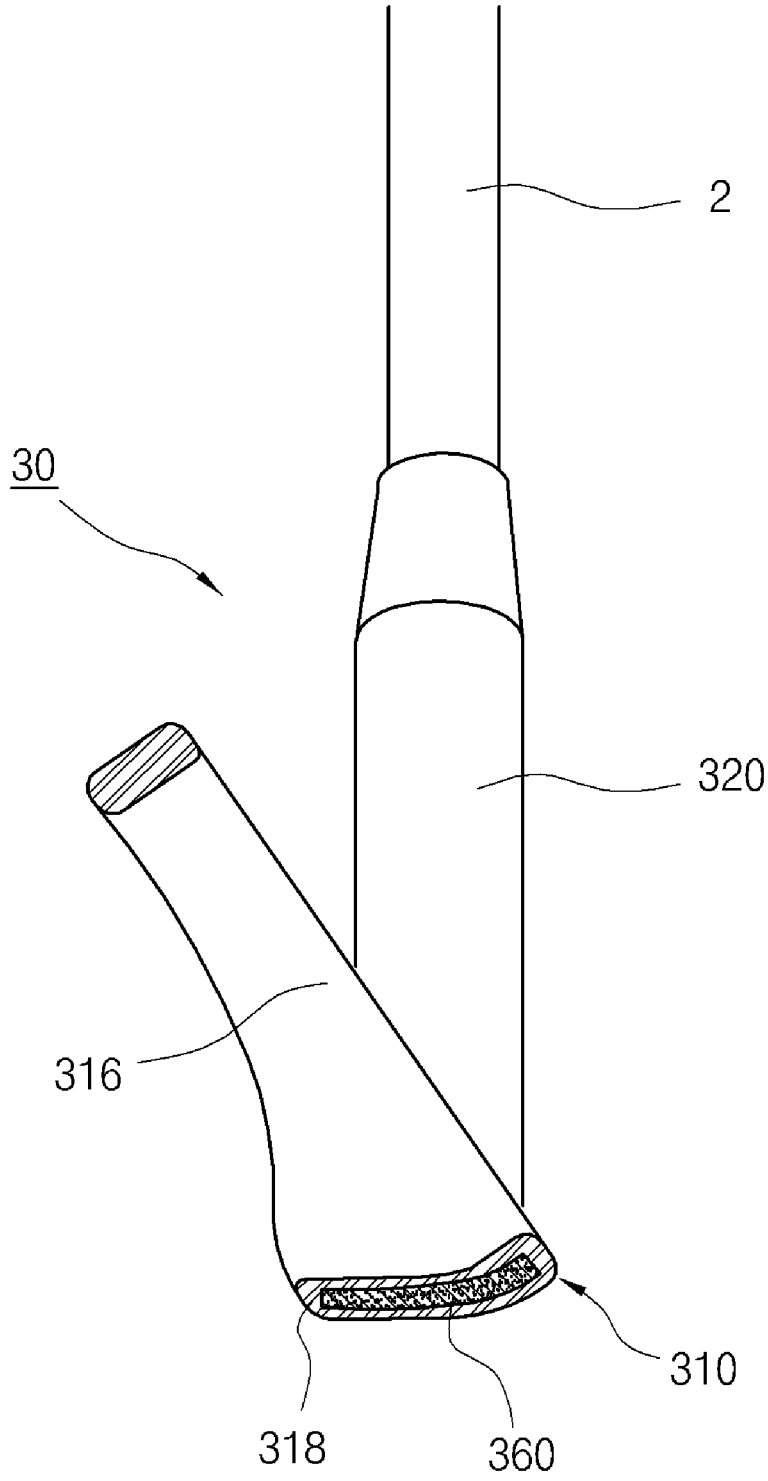
FIG. 8 is a sectional view of a golf club head according to the third embodiment of the present invention.

FIG. 8 is a sectional view of a golf club head according to the third embodiment of the present invention. Referring to FIG. 8, a head 30 according to the third embodiment includes a body 310 and a shaft housing 320 formed on a side of the body 310.

The head 30 may be formed of a lightweight compound resin that is easy to form and has a high degree of strength.

Furthermore, a weight-balancing portion 318 is formed on one side of the body 310 to provide a weighted feel. The weight balancing portion 318 may be formed on the rear, lower surface of the body 310.

Also, a balancing weight 360 is formed on the weight balancing portion 318, and may be insert injection molded in the body 310.

Accordingly, when a golfer swings the club with the above-structured head 30 according to the third embodiment, the swing is aided by centrifugal force imparted by the balancing weight 360. Also, the compound resin material that is easily formed and strong, may be embodied in various forms to be suitable for use by players with varying physical abilities.

The head 310 may be employed in the same manner as the heads described in the first and second embodiments.

An advantage of a golf head for a soft golf club according to the present invention is that it has a loft angle and lie angle of a conventional golf club head, and provides an elastic striking surface on the head which can be adjusted according to the physical requirements of the golfer. Therefore, elderly and physically disabled golfers can enjoy the sport, so that the demography of active golfers can be expanded.

Furthermore, by reducing the flight distance of a golf ball, the size of a golf course can be reduced accordingly, so that golf can not only be enjoyed on outdoor courses, but indoors as well.

Additionally, the soft golf club head can be used not only by physically impaired people, but also by physically fit people indoors, and can provide the feeling of playing on an actual green while helping to improve one's stance, stroke, etc.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A golf head for a soft golf club having a shaft forming a gripping portion at a top thereof, and a head coupled at a lower end of the shaft and forming a striking surface for striking a golf ball, the golf head comprising:

a body with an outer circumference of a predetermined thickness forming a striking space in a center thereof, and a plurality of insert holes formed in the outer circumference;

a shaft housing formed on a side of the body, and including a receiving hole in which a lower end of the shaft is inserted and fixed;

at least one string for forming the striking surface over the striking space on the body, wherein one end of the string is inserted in one of the insert holes, and the other end is inserted in another of the insert holes corresponding to the one insert hole;

at least one bumper respectively formed on each of the insert holes, for minimizing a transferal of striking shock from the striking surface formed by the string to edges of the insert holes; and a tension adjusting screw to which the one end of the string is fixed, the tension adjusting screw tightening or loosening the one end of the string and controlling the tension of the striking surface, wherein:

the outer circumference of the body includes a recessed region recessed a predetermined depth inward from an outer surface thereof;

the insert holes and the bumper are formed in the recessed region of the body, and the tension adjusting screw is provided on an outer region of the body other than the recessed region of the body and is spaced apart from the bumper; and the bumper includes a through hole through which the string is slidably movable when the one end of the string is tightened or loosened by the tension adjusting screw.

2. The golf head of claim 1, wherein the golf head has a loft angle and a lie angle, for retaining a shape of a conventional golf club.

3. The golf head of claim 1, wherein the soft golf club retains a shape of an iron golf club, and the golf head has a loft angle for the iron golf club.

* * * * *